US008550027B2

(12) United States Patent
May

(10) Patent No.: US 8,550,027 B2
(45) Date of Patent: Oct. 8, 2013

(54) COLOR GUARD ADJUSTABLE FLAG POLE WEIGHT

(76) Inventor: Randall L. May, Irvine, CA (US)

( * ) Notice: Subject to any disclaimer, the term of this patent is extended or adjusted under 35 U.S.C. 154(b) by 345 days.

(21) Appl. No.: 13/030,041

(22) Filed: Feb. 17, 2011

(65) Prior Publication Data

US 2011/0197803 A1 Aug. 18, 2011

Related U.S. Application Data

(60) Provisional application No. 61/305,848, filed on Feb. 18, 2010.

(51) Int. Cl.
*G09F 17/00* (2006.01)

(52) U.S. Cl.
USPC ..... 116/173; 84/477 B

(58) Field of Classification Search
USPC ..... 116/173, 174; 40/586; 84/477 B; 446/236, 266
See application file for complete search history.

(56) References Cited

U.S. PATENT DOCUMENTS

| | | | | | |
|---|---|---|---|---|---|
| 2,092,354 | A * | 9/1937 | Leonard | 84/477 B |
| 3,212,386 | A * | 10/1965 | Sartell | 84/477 B |
| 3,354,770 | A * | 11/1967 | Haug | 84/477 B |
| 3,603,196 | A * | 9/1971 | Dolfi | 84/477 B |
| 3,810,411 | A * | 5/1974 | Schambacher | 84/477 B |
| 3,960,311 | A | 6/1976 | Griffiths | |
| 4,079,555 | A | 3/1978 | Barnes | |
| 4,383,387 | A * | 5/1983 | Puskar | 446/236 |
| 4,493,344 | A | 1/1985 | Mathison et al. | |
| 5,647,591 | A * | 7/1997 | Parsons | 463/47.4 |
| 5,827,108 | A * | 10/1998 | Spector | 446/266 |
| 6,379,286 | B1 * | 4/2002 | Scopino et al. | 482/93 |
| 7,575,209 | B1 | 8/2009 | Wiese | |
| 2006/0160463 | A1 * | 7/2006 | Orr et al. | 446/236 |
| 2010/0152002 | A1 * | 6/2010 | Knight | 482/93 |

FOREIGN PATENT DOCUMENTS

GB 2373454 A * 9/2002

* cited by examiner

*Primary Examiner* — R. A. Smith
(74) *Attorney, Agent, or Firm* — Kirk A. Buhler; Buhler & Associates

(57) ABSTRACT

An improvement in a color guard flag pole weight is disclosed. The flag pole weight is inserted into one or both ends of a flag pole. For larger or heavier flag poles or when a performer is performing a great deal of spinning against the wind, weighting the pole dramatically improves the ease of rotation of the flag pole to counteract the drag created when the flag pole catches the wind and improves the ease of rotation for both the spinning and the tossing. When the weight is inserted into the flag pole, a split ring on the weight is expandable to grip the inside diameter of the pole. The weight of the insert is adjustable by screwing one or more weights into the insert. The additional weights are male-female threaded to allow for a large number of weights to be added and limited only to the length of the flag pole.

20 Claims, 3 Drawing Sheets

COLOR GUARD ADJUSTABLE FLAG POLE WEIGHT

CROSS REFERENCE TO RELATED APPLICATIONS

This application claims the benefit of Provisional 61/305,848 filed Feb. 18, 2010 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in an adjustable color guard flag pole weight. More particularly, the present adjustable flag pole weight is inserted and retained in the hollow interior diameter of a flag pole. The insertable retainer includes a threaded based member where one or more weights can be secured to the retainer to alter the weight of the flag pole used in color guard.

2. Description of Related Art Including Information Disclosed Under 37 CFR 1.97 and 1.98.

Occasionally, the silk of a color guard flag pole is lightweight enough that additional weight is not needed to balance out the pole. For larger or heavier silks or for times when the performer will be performing a great deal of spinning against the wind, weighting the pole can dramatically improve the ease of rotation of the flag pole. Weighting a color guard flag pole helps to counteract the drag created when the silk catches the wind. If the flag pole is weighted properly, the weight helps to balance the pole and improve the ease of rotation for both the spinning and the tossing.

There are several ways that people have weighted flag pole poles. Some methods include inserting PVC sleeves inside the flag pole. Another common method is to tape pennies inside the ends of the flag pole. The most common method used to weight a color guard flag pole is with insertion of a ½ inch carriage bolt. The carriage bolts can be purchased in various lengths to provide different weights by removing a bolt of one length and replacing it with a bolt of a different length. Some companies offer flag pole weights that are fixed in weight, and removal of the weights is often difficult because the weight sticks inside the pole and must be destroyed upon removal.

There are a number of patents that have been issued that work to plug the end of a pipe. The majority of theses plugs use a metallic cone or an elastomeric washer that is squeezed to expand and fill and seal the plug within the inside diameter of the pipe. While these devices grip the inside of the pipe, they are not configured for the addition of weights. A number of these seals also are not removable and permanently seal the open end of a pipe.

There are also a number of patents for dumbbells or the like that use weights that are threaded into the handle of the dumbbell to alter the weight of the dumbbell. While these dumbbells provide a variable weight to the dumbbell they are not configured to fit within the tubular shaft of a color guard flag pole.

What is needed is an adjustable color guard flag pole weight that is insertable and expandable into the tube of a color guard flag pole and is also removable. The ideal product also includes the ability to change the weight by adding or removing threaded weights into the insertable member. The proposed color guard adjustable flag pole weight provides a solution to the problem of easily changing the precise weight of a color guard flag pole.

BRIEF SUMMARY OF THE INVENTION

It is an object of the color guard adjustable flag pole weight for the flag pole weight to be inserted and removed from the inner diameter of a flag pole. The ability to insert and remove the weight allows the weight to be changed based upon the weight of the flag pole, the type of performance and the wind, rain, moisture and other atmospheric conditions. The flag pole weight has a shoulder that allows the weight to be held by an installer's fingers and further prevents the weight from being inserted too far into the center of the tube.

It is an object of the color guard adjustable flag pole weight to have a fastening means that allows the weight to be retained in the flag pole. The retention means is a split ring that sits in a recess of the flag pole weight shank. The split ring normally exists with an outside diameter that is less than the inside diameter of the flag pole. When a screw, located in the end of the flag pole weight, is turned the screw pushes on pins or balls that push on the split pin to expand the split ring until it binds with the inside diameter of the flag pole. The binding locks the flag pole weight within the flag pole until the screw is sufficiently backed out of the flag pole weight to release the split ring.

It is another object of the color guard adjustable flag pole weight to have an internal threaded area that allows for securing one or more weight inserts. The weight inserts are configured with a male and female end such that multiple weight inserts can be connected together with the only limitation being the length of the flag pole. The length and diameter of the weight inserts can also be varied to provide for a finer resolution of weights.

It is still another object of the color guard adjustable flag pole weight to have a rounded end that allows the flag pole weight to be inserted in either end of the flag pole. The rounded end has an opening for the insertion of a tool for expanding the split washer. The weights on each end of the flag pole can be different to allow for tuning of the flag pole weight to adjust for the weight of the flag pole, weather and or user preference. The rounded end can take a variety of shapes including a bulbous end that makes the end of the flag pole easier to grasp for spinning or twirling.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
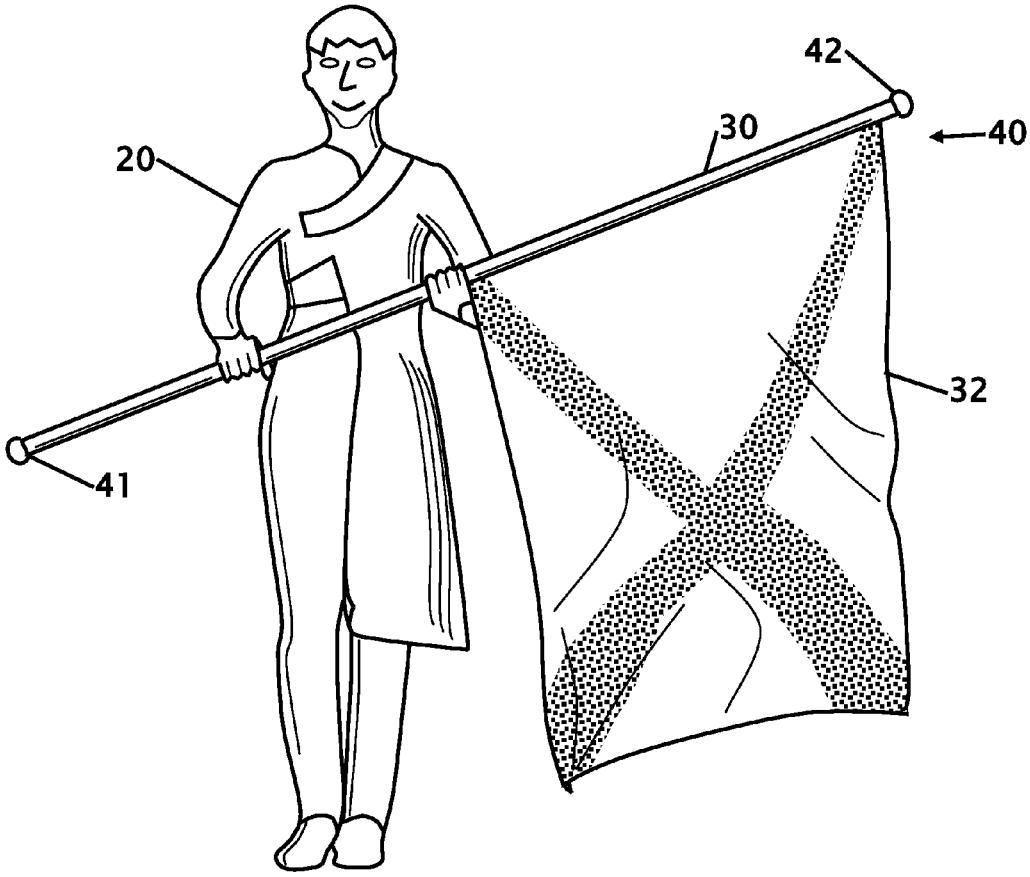
FIG. 1 shows a view of a color guard performer with a color guard flag pole having the adjustable flag pole weights.

FIG. 1 shows a view of a color guard performer 20 with a color guard flag pole 30 having the adjustable flag pole weights. The color guard performer 20 generally performs with flag poles, rifles or the like. The flag pole 30 and flag pole 30 assembly 40 is turned, waved or thrown into the air during the performance. The size, shape and material of the pole 32 as well as the weather conditions can affect how the pole 32 moves through the air. To offset the characteristics of the pole 32 and the weather one or both of the ends, shown generically as, 41 and or 42 and detailed as 53 and 59 in FIGS. 3, 5, 6 and 7, are weighted. The length of the flag pole 30 is generally long to allow a performer 20 to hold the flag pole 30 in both hands at the same time. In the long flag pole 30 the ends caps 41 and 42 are slightly rounded to easily slide out of a loosened hand. In other embodiments the flag pole 30 is shorter as shown and described with FIG. 2.

Figure 2:
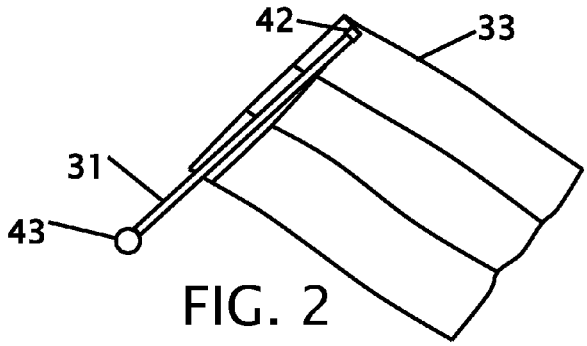
FIG. 2 shows a view of a shortened flag pole shaft with a bulbous end.

FIG. 2 shows a view of a shortened flag pole shaft with a bulbous end 43. The shorter flag pole 31 allows a performer to hold the flag pole with only one hand and flip the flag pole more quickly in the air. This flag pole is shown with one bulbous end 43. The bulbous end makes the flag pole easier to hold the flag pole at the bulbous end with just one hand and swing or pivot the flag pole 33 like a ball and socket joint where the bulbous end, shown generically as, 43 is the ball and the performers hand forms the socket. Generally with this type of flag pole the upper plug 42 is similar or the same as the upper plug used in the long pole 30 as shown in FIG. 1. The weight of the end plugs in the shorter flag pole can also be adjusted, and the method and design of one or more preferred embodiments are shown and described in FIGS. 3-7.

Figure 3:
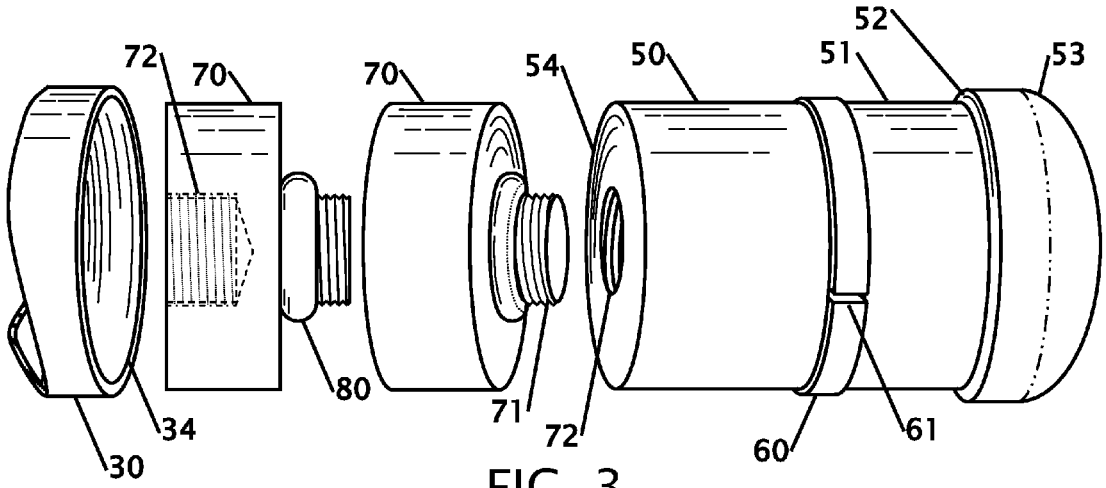
FIG. 3 shows a perspective view of the adjustable flag pole weight components.

FIG. 3 shows a perspective view of the adjustable flag pole weight components. The flag pole weight is configured to fit within the center of the flag pole 30 where it is not noticed and does not restrict hand movement with the flag pole. The flag pole weight is further designed to be inserted, removed, weight adjusted and returned to the flag pole 30 with minimal effort. The end cap of a color guard flag pole has a rounded end 53 with a shoulder 52. The rounded end 53 reduces the potential of injury to a performer if they are struck or hit someone or something with the end of the flag pole. The shoulder 52 prevents the flag pole weight from being inserted too far into the flag pole. The outer diameter of the shoulder 52 is preferably the same diameter as the outer diameter of the flag pole 30 to create a smooth transition from the pole 30 to the end cap 53.

An elongated shank exists both above 51 and below 50 a split ring 60. The elongated shank 50/51 provides both a guide and a bearing surface for the flag pole weight. The split ring 60 is preferably located along the center of the elongated shank 50/51. The location of the split ring 60 must be placed sufficiently from the shoulder 52 to reduce the possibility of splitting the flag pole with the split ring 60 is expanded to grip the inside diameter 34 of the flag pole 30. A split 61 in the split ring 60 allows the outside diameter to expand to grip the inside diameter 34 of the flag pole. Various materials are contemplated for the end plug. In the preferred embodiment the end plug is made from a strong but fairly light weight material such as aluminum, but other material are contemplated such as plastic. It is also contemplated that the end plug can be manufactured from a heavier material to provide some initial weight. Some heavier materials that are contemplated include but are not limited to copper alloys, stainless steel and other non-toxic and or non-rusting materials. Still other materials that are contemplated are hard rubbers that will still maintain some mechanical structure but also will provide some flexibility if impacted.

The bottom of the end cap is generally a flat bottom 54 with a female threaded hole 72. The female threaded hole allows for a weight 70 to be threaded into the female threaded hole 72. The weight 70 is constructed in a smaller diameter than the inside diameter 34 of the flag pole 30. The opposing end of the weight 70 also has a female threaded hole 72 to allow for additional weights to be screwed together using the male 71 and female 72 threaded screws and holes. A washer 80 is used to both cushion the interface of the weights and prevent the weights from unscrewing. In FIG. 3 two weights are shown where they can be screwed into the end plug. While two weights are shown, as few and no weights to as many as possible that can fit within the length of the flag pole 30 are contemplated. The weights 70 are also shown as being the same length, but other various lengths and weights are contemplated based upon the desired resolution of weight increments. The weights 70 are contemplated to be made out of heavier materials that include but are not limited to copper alloys, stainless steel and other non-toxic and or non-rusting materials.

Figure 4:
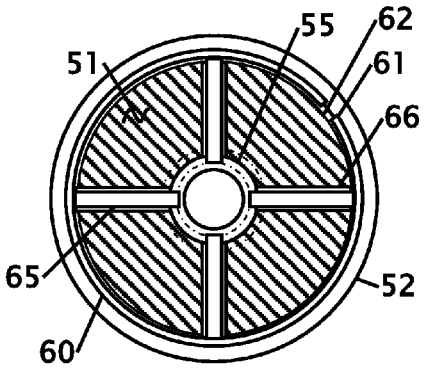
FIG. 4 shows a cross sectional view of the flag pole weight cut just above the split ring.
Figure 6:
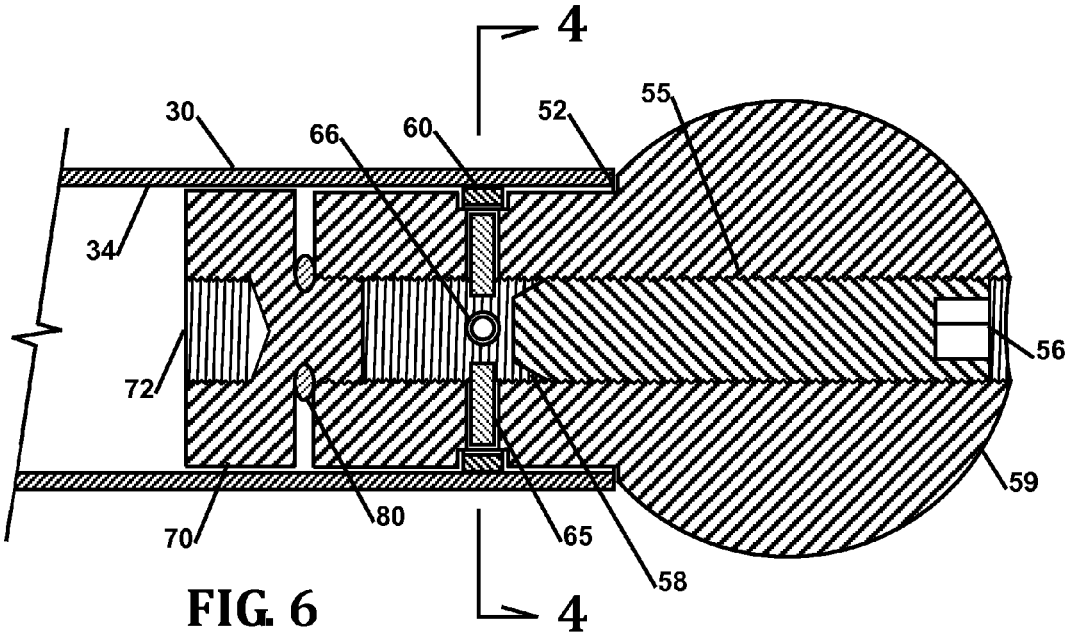
FIG. 6 shows a cross sectional view cut lengthwise through the adjustable flag pole weight with a bulbous end.

FIG. 4 shows a cross sectional view of the flag pole weight cut just above the split ring 60 cut through section 4-4 in FIG. 6. The split ring 60 exists within a recess 62 as shown in the sectional view in FIG. 3. The split 61 in the ring is obvious in this figure. The split is shown in an exaggerated opening to make it more visible. In the preferred embodiment the split 61 is perpendicular with the ring 60, but it is also contemplated that the split 61 can exist at an angle to reduce the possibility that the split will occupy the area over the expansion pins 65. The expansion pins 65 exist in holes 66. The holes 66 are sided to provide clearance for the pins 65 to freely slide. The holes 66 pass from the center of the elongated shank 51 to the outside of the elongated shank 51. A screw 55 with a tapered head pushes the pins 65 outward when the screw is turned into the end plug. The shoulder 52 of the end plug is visible outside of the cylinder 51 and split ring 60.

Figure 5:
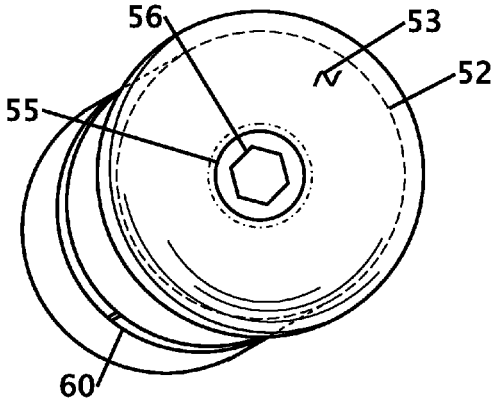
FIG. 5 shows an end view of the adjustable flag pole weight showing the tool insert socket.

FIG. 5 shows an end view of the adjustable flag pole weight showing the tool insert socket. This view is the socket 56 for insertion of a hex key is visible. A hex key is inserted into the socket 56 to move the screw 55 into and out of the end cap. Movement of the screw 55 pushes the pins 65 as shown in FIG. 4. The domed/rounded end 53 of the end cap is visible with a broken line that represents the shoulder 52. A portion of the split ring 60 is visible as it passes around the cylindrical body of the end cap.

FIG. 6 shows a cross sectional view cut lengthwise through the adjustable flag pole weight with a bulbous end 59. In this figure the screw 55 is backed away from the pins 65. The screw 55 is backed away from the pins to allow the end cap to be inserted into the end of the pole 30. To move the screw 55, a hex key is inserted into the socket 56, the end 59 of the end cap is held, and the hex key is turned to screw or unscrew the screw 55. The end cap is inserted until the end of the pole 30 makes contact with the shoulder 52 of the end cap. The cylindrical shaft of the end cap is configured to fit within the inside diameter 34 of the pole 30. In this figure one weight 70 is shown inserted or screwed into the end cap. The washer 80 is shown in a compressed condition to reduce movement of the weight 70 and to prevent the weight 70 from unscrewing from the end cap. The weight 70 is shown with a female socket 72 for connection with additional weights.

When the screw 55 is turned into the end cap the tapered end 58 of the screw 55 pushes into the pins 65 to push the pins, through the clearance holes 66, against the split ring 60 to make the split ring grip the inside diameter 34 of the flag pole 30. The taper 58 of the screw 55 pushing against the pins and then the split ring is shown in more detail with FIG. 7.

Figure 7:
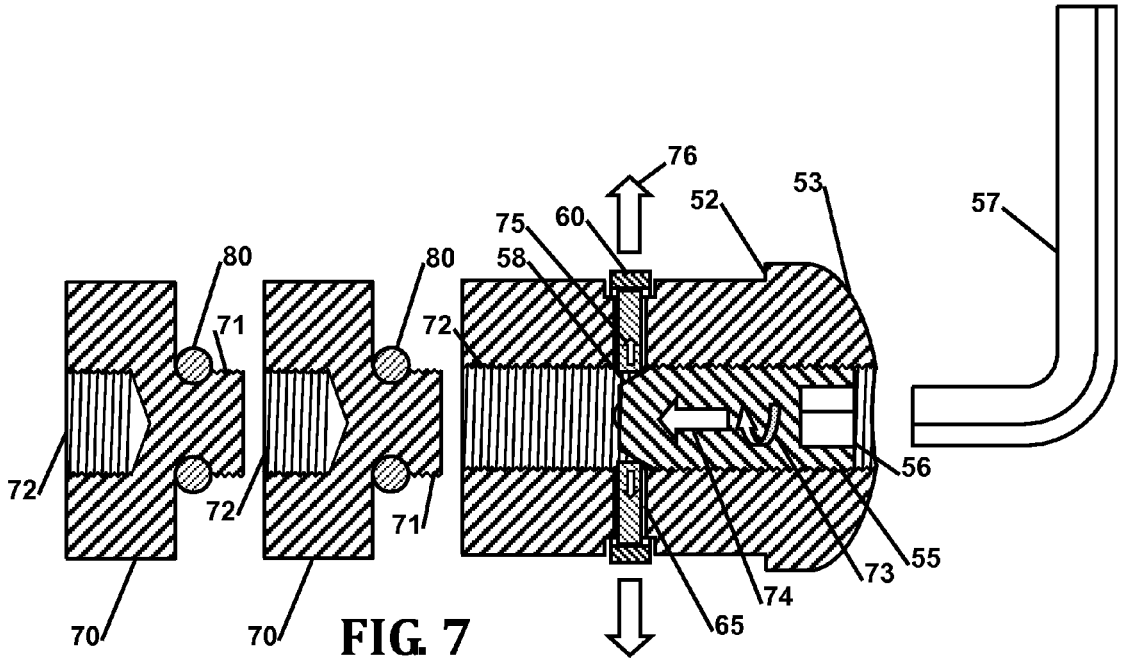
FIG. 7 shows a cross sectional view cut lengthwise through the adjustable flag pole weight showing the expansion of the split ring.

FIG. 7 shows a cross sectional view cut lengthwise through the adjustable flag pole weight showing the expansion of the split ring 60. The shoulder 52 of the end plug prevents the end plug from being inserted too far into a flag pole and also provides an area for the person to grasp the end plug. The rounded end 53 of the end plug provides a smooth rounded surface. This figure has a hex key 57 shown where it can engage into the hex socket 56 of the sect screw 55. As the screw 55 is turned clockwise as shown with arrow 73 the screw moves into as shown with arrow 74 the end cap and the tapered 58 end or nose of the screw 55 pushes pins 65 out as shown with arrow 75 through the clearance holes 65 where the pins push the split ring 60 out as shown with arrow 76. This figure shows two weights 70 that can be screwed together and into the end cap using the male 71 and female threaded holes 72 and screws 71. The O-rings or washers 80 reduce movement of the secured weights and prevent the weight from unscrewing while the flag pole is moved.

Thus, specific embodiments of a color guard adjustable flag pole weight have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A color guard adjustable flag pole weight comprising:
- a flag pole end insert having a first rounded end located on a shoulder and an essentially flat second end;
- said pole end insert further having an elongated shaft located between said shoulder and said second end;
- said elongated shaft further having a retention mechanism for a split ring, and
- said second end having a retention mechanism to retain at least one weight that is securable onto said second end.

2. The color guard adjustable flag pole weight according to claim 1 wherein said split ring is expandable to grip an inside diameter of a pipe or tube.

3. The color guard adjustable flag pole weight according to claim 1 wherein said retention mechanism to retain at least one weight retains a plurality of weights.

4. The color guard adjustable flag pole weight according to claim 1 wherein said shoulder is larger in diameter than an inside diameter of said pole.

5. The color guard adjustable flag pole weight according to claim 1 wherein said split ring is expanded by a plurality of pins or balls that push out from within said elongated shaft.

6. The color guard adjustable flag pole weight according to claim 5 wherein said expansion is with a screw or bolt that pushed upon said plurality of pins or balls.

7. The color guard adjustable flag pole weight according to claim 1 wherein said at least one weight has male and female threads on opposing sides of said at least one weight.

8. The color guard adjustable flag pole weight according to claim 1 wherein said at least one weight is made from steel, aluminum, brass, bronze, copper or plastic.

9. A color guard adjustable flag pole weight comprising:
- a flag pole end insert having a first end and a second end;
- said pole end insert further having an elongated shaft located between said first end and said second end;
- said elongated shaft further having a first retention mechanism for securing said flag pole end insert;
- said first retention mechanism is with at least one pin, screw or ball that pushes out from within said elongated shaft, and
- said second end having a second retention mechanism to retain at least one weight that is securable onto said second end.

10. The color guard adjustable flag pole weight according to claim 9 wherein said second retention mechanism to retain at least one weight is with threads.

11. The color guard adjustable flag pole weight according to claim 9 wherein said second retention mechanism further includes at least a third retention mechanism to retain at least a second weight that is secured onto said second end into said second retention mechanism.

12. The color guard adjustable flag pole weight according to claim 9 wherein said first end has a shoulder that is larger in diameter than an inside diameter of said flag pole.

13. The color guard adjustable flag pole weight according to claim 9 wherein a screw that is accessible from said first end can be turned to push upon said at least one pin, screw or ball.

14. The color guard adjustable flag pole weight according to claim 9 wherein said at least one weight has male and female threads on opposing sides of said at least one weight.

15. The color guard adjustable flag pole weight according to claim 9 wherein said at least one weight is made from steel, aluminum, brass, bronze, copper or plastic.

16. A color guard adjustable flag pole weight comprising:
- a flag pole end insert having a first end and a second end;
- said pole end insert further having an elongated shaft located between said first end and said second end;
- said elongated shaft further having a first retention mechanism for securing said flag pole end insert;
- said second end having a second retention mechanism to retain at least one weight that is securable onto said second end, and
- wherein said at least one weight has male and female threads on opposing sides of said at least one weight.

17. The color guard adjustable flag pole weight according to claim 16 wherein said second retention mechanism to retain at least one weight is with threads.

18. The color guard adjustable flag pole weight according to claim 16 wherein said second retention mechanism further includes at least a third retention mechanism to retain at least a second weight that is secured onto said second end into said second retention mechanism.

19. The color guard adjustable flag pole weight according to claim 16 wherein said first end has a shoulder that is larger in diameter than an inside diameter of said flag pole.

20. The color guard adjustable flag pole weight according to claim 16 wherein said at least one weight is made from steel, aluminum, brass, bronze, copper or plastic.

* * * * *